US005800121A

United States Patent [19]

Fanelli

[11] Patent Number: 5,800,121

[45] Date of Patent: Sep. 1, 1998

[54] PNEUMATIC ELECTRIC GENERATING SYSTEM

[76] Inventor: August J. Fanelli, 43 W. Buckingham Ave., Mt. Ephraim, N.J. 08059

[21] Appl. No.: 824,768

[22] Filed: Mar. 26, 1997

[51] Int. Cl.[6] ..... F01D 1/02

[52] U.S. Cl. ..... 415/199.5; 415/58.5; 415/59.1; 416/189

[58] Field of Search ..... 415/199.4, 199.5, 415/58.5, 58.7, 59.1, 57.2, 58.1, 66, 61, 202, 207; 416/183, 185, 189, 193 R, 195; 60/325, 484, 486

[56] References Cited

U.S. PATENT DOCUMENTS

| | | | |
|---|---|---|---|
| 2,792,197 | 5/1957 | Wood . | |
| 3,302,866 | 2/1967 | Ferri . | |
| 3,802,797 | 4/1974 | Bintz et al. . | |
| 4,140,433 | 2/1979 | Eckel | 415/60 |
| 4,315,715 | 2/1982 | Nishiguchi et al. . | |
| 4,424,452 | 1/1984 | Francis | 415/61 |
| 4,774,911 | 10/1988 | Yamaguchi et al. . | |
| 5,734,202 | 3/1998 | Schuler | 290/55 |

FOREIGN PATENT DOCUMENTS

| | | |
|---|---|---|
| 2260001 | 8/1975 | Germany . |
| 4226664 A1 | 3/1994 | Germany . |
| 58-131372 | 8/1983 | Japan . |
| 58-190583 | 11/1983 | Japan . |
| 162717 | 4/1921 | United Kingdom . |

*Primary Examiner*—Edward K. Look
*Assistant Examiner*—Richard Woo
*Attorney, Agent, or Firm*—Lennox & Murtha

[57] ABSTRACT

An apparatus is provided for generating power, including modules connected in a closed loop. At least one module includes a duct. A motive fluid passes through the duct from the upstream side to the downstream side. An inlet fan is mounted in the duct at the upstream side for rotation about an axis. A motor or engine drives the inlet fan. A reaction turbine wheel is mounted in the duct downstream of the inlet fan on a rear shaft. The reaction turbine wheel has a plurality of pressure chambers disposed about the periphery of the reaction turbine wheel. The reaction turbine wheel is rotatable about the axis in a first direction, and the pressure chambers are curved from an upstream portion to a downstream portion in a second direction, opposite the first direction. An exhaust stator is mounted to the duct downstream of the reaction turbine wheel. An aft fan is mounted to the duct for rotation about the axis and is operably engaged to a rear axle. The rear axle is also attached to the reaction turbine wheel such that the aft fan rotates at a fixed speed with respect to the reaction turbine wheel. A power means is operably engaged to the reaction turbine wheel such that rotation of the reaction turbine wheel results in the generation of power.

20 Claims, 6 Drawing Sheets

PNEUMATIC ELECTRIC GENERATING SYSTEM

BACKGROUND OF THE INVENTION

This invention is related to the field of energy generation.

In particular, the invention is directed to a method and apparatus for the generation of power. As currently envisioned, the system is employed as a free standing power generator, such as for a utility company. However, the components of the systems may be sized to operate as an on-board power system for a vehicle, for power for a dwelling or other building, or any other such use.

It has long been known that energy in a moving fluid, such as air, could be harnessed to turn a turbine or A similar fan. The rotating turbine turns a shaft which, in turn, could be attached to some means to produce power. For example, the shaft could be attached to an electric generator which would produce electric power by moving magnets passed wires, or by moving wires through an electromagnetic field or other ways well-known in the art. Various designs have been employed to achieve a greater efficiency in such turbine generators by modifying the fan designs and altering the delivery of the fluid.

U.S. Pat. No. 2,792,197 discloses a gas turbine apparatus having a casing with a hot gas inlet at its periphery. The casing defines an annular chamber for receiving the hot gas and an axial gas discharge opening for expelling it. A turbine wheel is rotatably supported in the casing. Radial blades extend from the front face of the wheel. A seal between the casing and the back face of the wheel divides the back face into an inner portion and an outer portion. The inner portion is connected to ambient atmosphere. The outer portion provides an annular space between the casing. The seal includes sealing members arranged for pressure activation in a direction toward the sealing direction. Circumferentially-spaced, inclined nozzles direct gas radially inward against the blades, thereby rotating the wheel. The gas exits through the discharge opening and exerts a backward thrust on the wheel. A passage places the peripheral portion in communication with the hot gas discharged from the nozzles. The hot gas pressure acting on the back face exerts a forward thrust on the wheel which is substantially equal to and opposite to the backward thrust and activates the sealing member toward its sealing position.

U.S. Pat. No. 3,302,866 is directed to a high velocity fluid accelerator. A housing has a fluid inlet and a fluid outlet. A vaned rotor is positioned in the housing. The vanes of the rotor are shaped and positioned to turn fluid impinging thereon through an angle of greater than 90°. The rotor is positively driven. A nozzle injects fluid at supersonic velocity through the inlet and into the vanes.

U.S. Pat. No. 3,802,797 discloses a reverse turbine flow divider support. The turbine has two coaxial rows of oppositely curved rotor blades and two rows of separately adjustable stator blades controlling the flow of a motive fluid alternatively to the forward or reversing rotor blades. A divider baffle is disposed between the outer and the inner liners of the inlet passage to the stator blades. The divider baffle guides the motive fluid to the row of stator blades being used during a selected mode of operation of the turbine.

SUMMARY OF INVENTION

It is an object of an aspect of the present invention to provide an improved power generating system.

It is a further object of an aspect of the present invention to provide a system for the generation of power using pressurized air passing through a closed loop.

It is a further object of an aspect of the current invention to provide an improved turbine wheel for use with a motive fluid which takes advantage of pressure differentials in the motive fluid to produce energy.

It is a further object of an aspect of this invention to take advantage of air pressure differentials in a generator by exploiting the law of physics which states that every action has an equal and opposite reaction.

It is a further object of an aspect of this invention to increase the energy output and efficiency of a generator by exploiting fluid pressure differentials within the system which are ignored or wasted by conventional power generating systems.

In accord with one aspect of the invention, an apparatus for generating power is provided. A plurality of modules are connected in a closed loop. At least one module includes a duct having an axis, an upstream side and a downstream side. A motive fluid passes through the duct from the upstream side to the downstream side. An inlet fan is mounted in the duct for rotation about an axis and is disposed proximate to the upstream side. Means are operably engaged to the inlet fan for driving the inlet fan. A central shaft is disposed along the axis of the duct for rotational movement. A reaction turbine wheel is mounted to the central shaft in the duct downstream of the inlet fan. The reaction turbine wheel has a plurality of pressure chambers defined by plates which are disposed about the periphery of an inner shroud. Each pressure chamber has an inlet and an outlet. The reaction turbine wheel is rotatable about the axis in a first circumferential direction. The plates are curved from an upstream portion to a downstream portion in a second circumferential direction, opposite the first direction. A rear stator is mounted to the duct downstream of the reaction turbine wheel and has blades disposed proximate to the outlet of the pressure chambers. An aft fan is mounted to the duct for rotation about the axis and is operably engaged to the central shaft via a gear box such that the aft fan rotates at a fixed speed with respect to the reaction turbine wheel. A power generation means is operably engaged to the reaction turbine wheel such that rotation of the reaction turbine wheel results in the generation of power.

Certain implementations of this aspect of the invention provide that: the plates are curved a significant amount in the second circumferential direction; the plates are curved between 45° and 80° with respect to the axis; the plates are curved about 70° with respect to the axis; the reaction turbine wheel has a circular profile, the inlet of each pressure chamber has a substantially rectangular shape and the outlet of each pressure chamber has a substantially rectangular shape, and the inlet has a greater surface area than the outlet; pressure vane extensions are mounted to an upstream side of the reaction turbine wheel between alternate adjacent plates, the pressure vane extensions providing a curved surface to the air for directing the air into the pressure chambers; the reaction turbine wheel includes at least one disc, the inner shroud has a cylindrical shape and is mounted to the disc coaxially with the central shaft, a series of arced plates extend radially from the inner shroud, an outer shroud has a cylindrical shape and is mounted to the plates distal to the inner shroud and coaxially with the central shaft, the pressure chambers are defined by adjacent arced plates, the inner shroud and the outer shroud, and face panels connect upstream edges of alternate consecutive pairs of arced plates and define pressure channels between the alternate adjacent pressure chambers; the inner shroud and the outer shroud are longer in the axial direction than the curved plates thereby defining a flow zone; the plates comprise a first portion and a second portion having a similar length in the axial direction, the first portion extends in a substantially axial direction and the second portion bends in the second circumferential direction.

In accord with another aspect of the invention, a turbine wheel having an inlet and an outlet for use with an electric power generator is provided. A central shaft has an axis, an upstream end proximate to the inlet and a downstream end proximate to the outlet. A front disc is mounted to the central shaft at the upstream end. A rear disc is mounted to the central shaft at the downstream end. An inner shroud has a cylindrical shape and is mounted to the front disc and the rear disc coaxially with the central shaft. A series of arced plates extend radially from the inner shroud. An outer shroud has a cylindrical shape and is mounted to the arced plates distal to the inner shroud, coaxially with the central shaft. The inner shroud, the outer shroud and the plates define pressure chambers. Face panels connect the front edges of alternate consecutive pairs of arced plates and define pressure channels between adjacent pressure chambers. The inner shroud and the outer shroud are longer in the axial direction downstream than the arced plates, thereby defining a downstream flow zone.

Certain implementations of this aspect of the invention provide that: the face plates comprise pressure vane extensions having a wedge shape with a point, wherein the point is directed to the inlet of the turbine wheel; the arced plates are curved a significant amount in a circumferential direction from the upstream end to the downstream end; the plates comprise a first portion and a second portion, wherein the first portion is upstream of the second portion, the first portion extends in a substantially axial direction and the second portion curves a significant amount in a circumferential direction; a downstream end of the second portion extends at about 70° with respect to the axis; flanges are mounted to the inlet edges of the plates and extend into the pressure chambers; the inner shroud and the outer shroud extend upstream beyond the plates; the pressure vane extensions are curved along the inner shroud parallel, at least in part, to the plates; the inlet of the pressure chamber has a larger surface area than the outlet of the pressure chamber.

In accord with another aspect of the invention, an apparatus for the generation of power using pressurized air is provided. A duct has an inlet end and an outlet end such that the pressurized air passes from an upstream position at the inlet to a downstream position at the outlet. A front stator is mounted to the duct for directing the air, at least in part, in a clockwise direction. An inlet fan is mounted in the duct downstream of the front stator for rotational movement. A means for rotating the inlet fan is attached to the inlet fan. A central shaft is disposed axially in the duct. A reaction turbine wheel is mounted to the central shaft for rotational movement in the duct. The reaction turbine wheel is disposed downstream of the inlet fan and includes an inner shroud and pressure chambers disposed about the inner shroud. The chambers are curved circumferentially in a counter clockwise direction along the surface of the inner shroud from the upstream side to the downstream side. Rear turning vanes are mounted in the duct downstream of the reaction turbine wheel for directing the air to a more axial direction. An aft fan is mounted to central shaft via a gear box and is disposed downstream of the rear turning vanes. The aft fan rotates at a fixed speed with respect to the reaction turbine wheel. A power generation means is operably engaged to the reaction turbine wheel such that the rotation of the reaction turbine wheel results in the generation of power.

Certain implementations of this aspect of the invention provide that the aft fan rotates at about 110% of the speed of the reaction turbine wheel.

DESCRIPTION OF PREFERRED EMBODIMENTS

Figure 1:
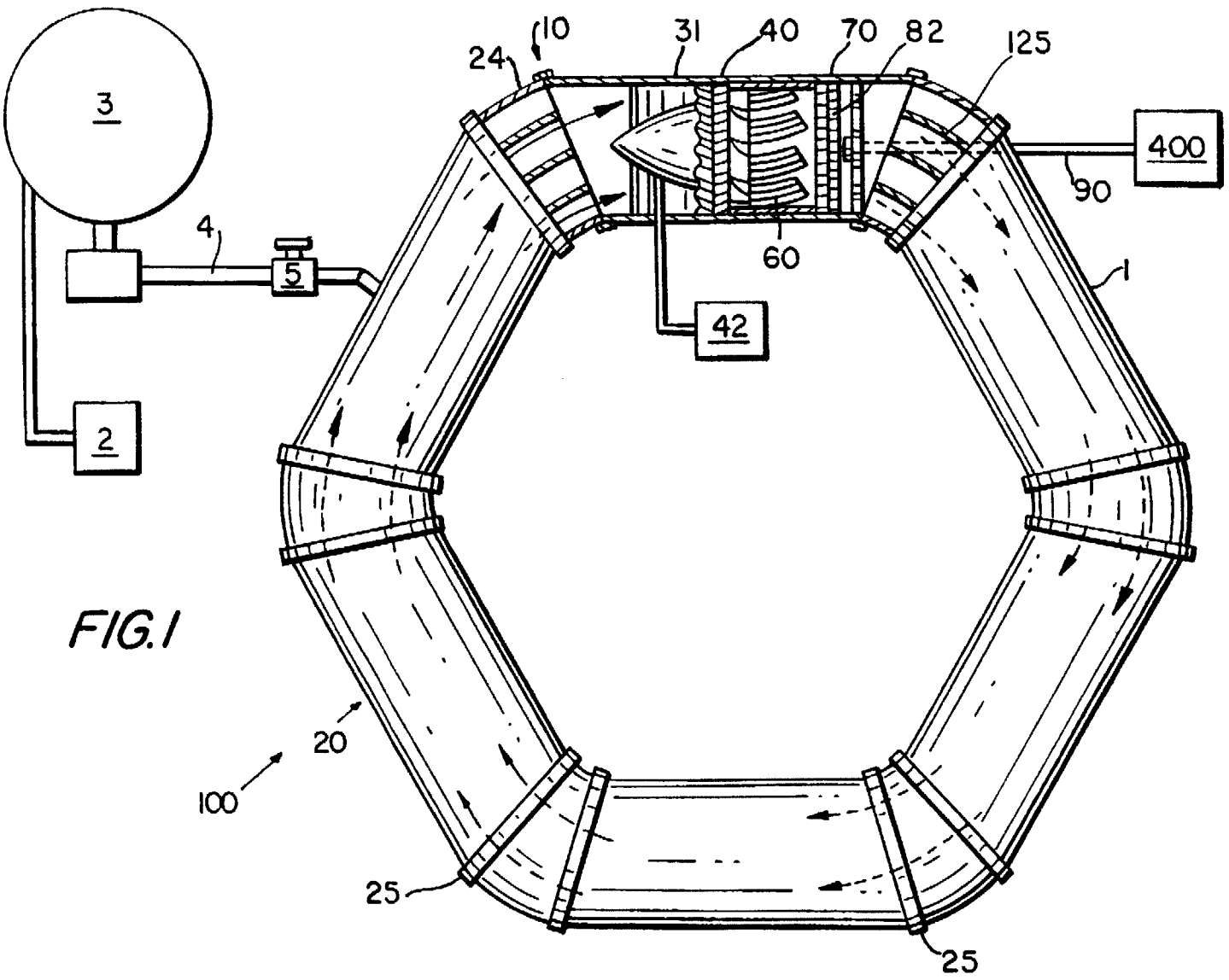
FIG. 1 is a top schematic view of a generating system in accord with an aspect of the invention.

A power generating system 100 in accord with an aspect of the instant invention is shown schematically in FIG. 1. At least three sections 1 are attached to form a closed loop 10. Preferably six sections are used, but a different number may be employed as a particular application dictates. A motive fluid, such as pressurized air, is contained in the loop and flows clockwise, as shown in FIG. 1. An air pump 2 is connected to an accumulator 3, such as an air tank. The accumulator is connected to the loop by a manifold 4. The manifold outlet is flush against the wall of the loop and may be angled to admit air into the loop already moving in the clockwise direction. The flow of high pressure air between the accumulator and the loop is controlled by a valve 5. As discussed more fully below, the valve permits the slow, controlled introduction of pressurized air into the loop, preventing damage that might result from introducing the high pressure air at too high a flow rate (such as freezing the components of the system).

Figure 4:
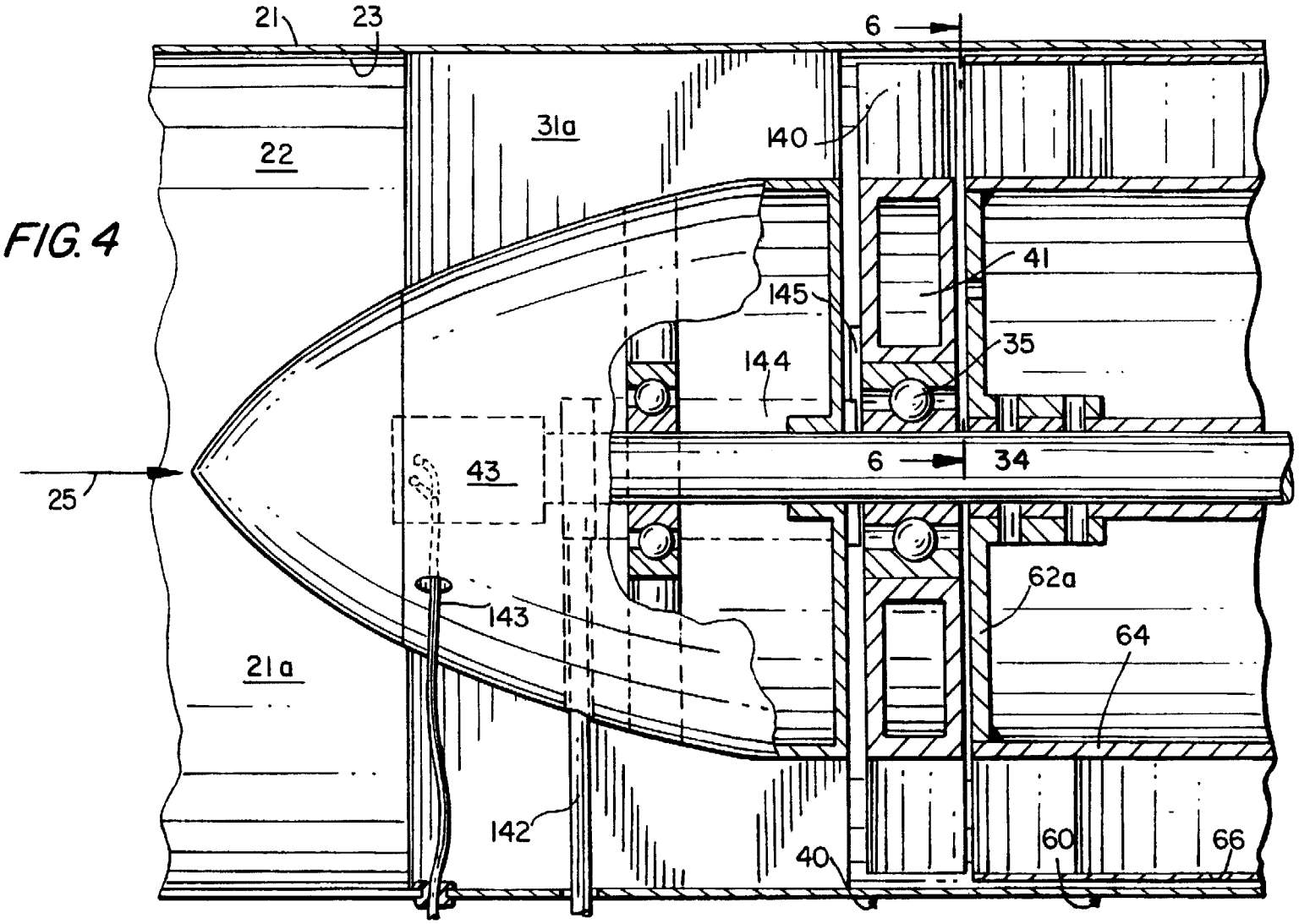
FIG. 4 is a top section view of the front portion of the module of FIG. 2.
Figure 5:
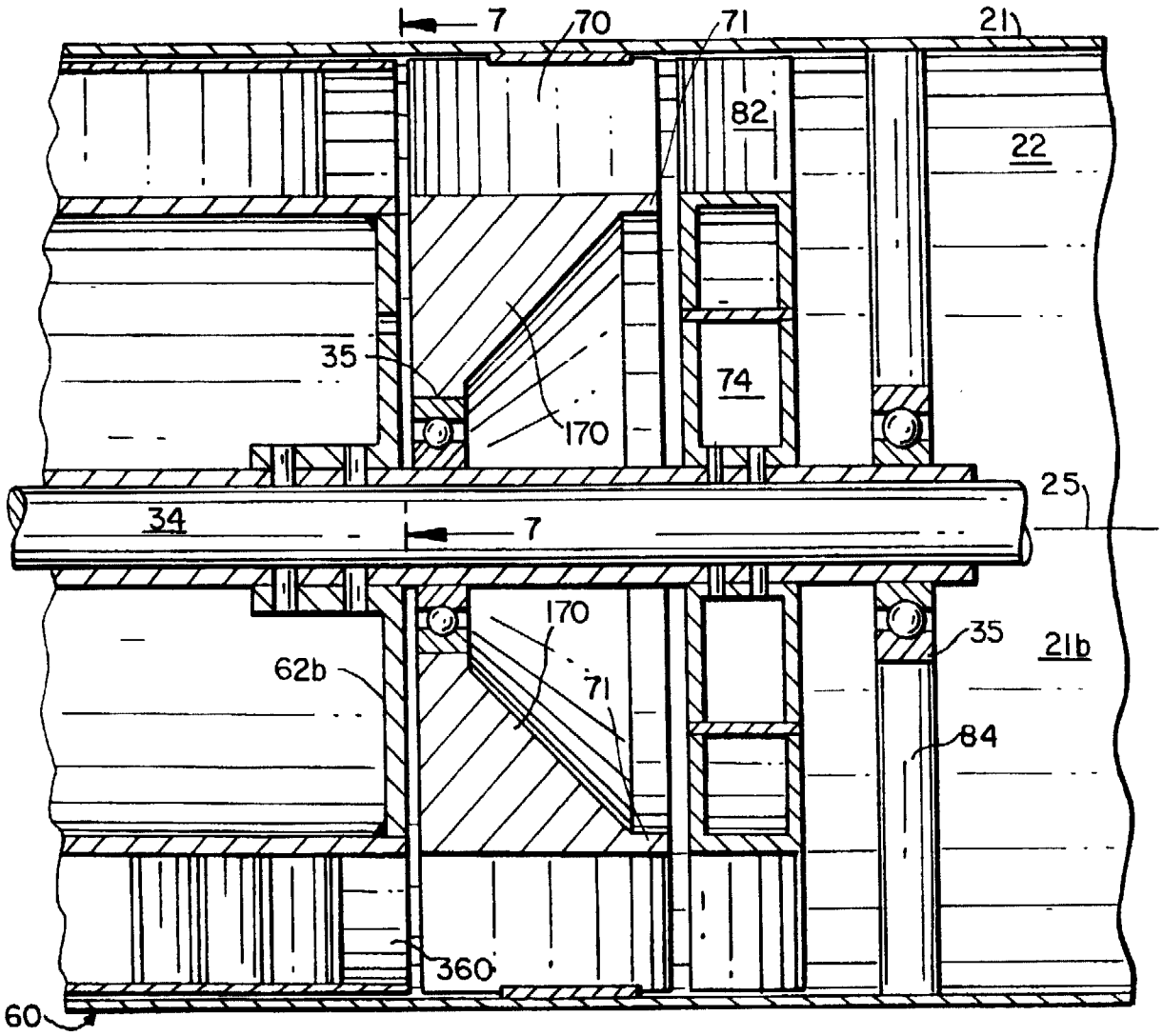
FIG. 5 is a top section view of the rear portion of the module of FIG. 2.
Figure 6:
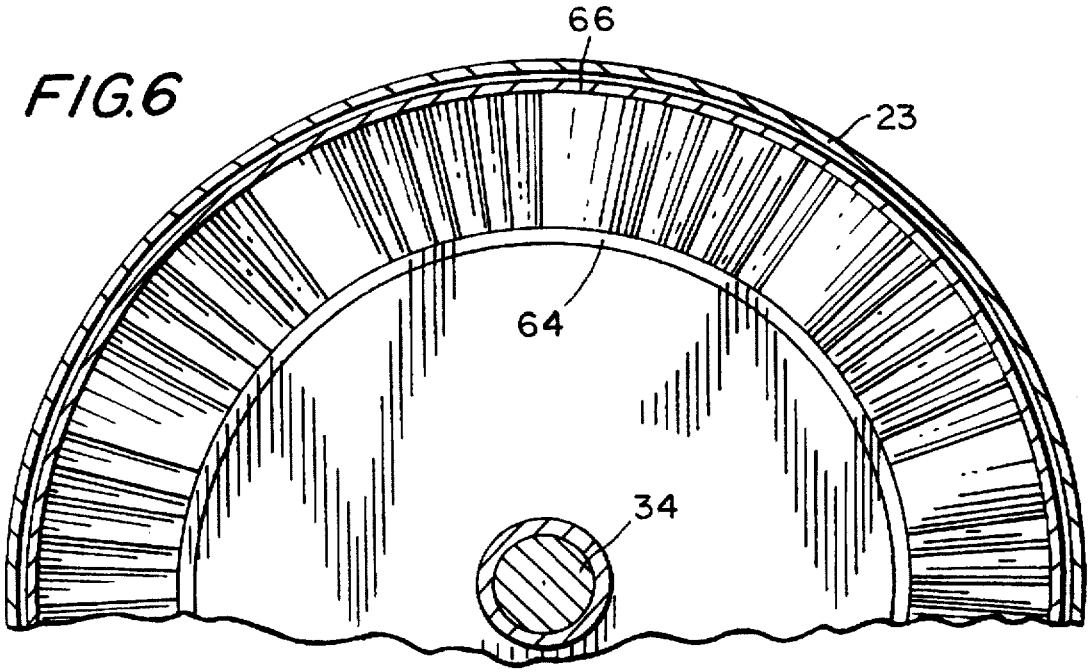
FIG. 6 is a front elevation view of the reaction turbine wheel of FIG. 3.
Figure 7:
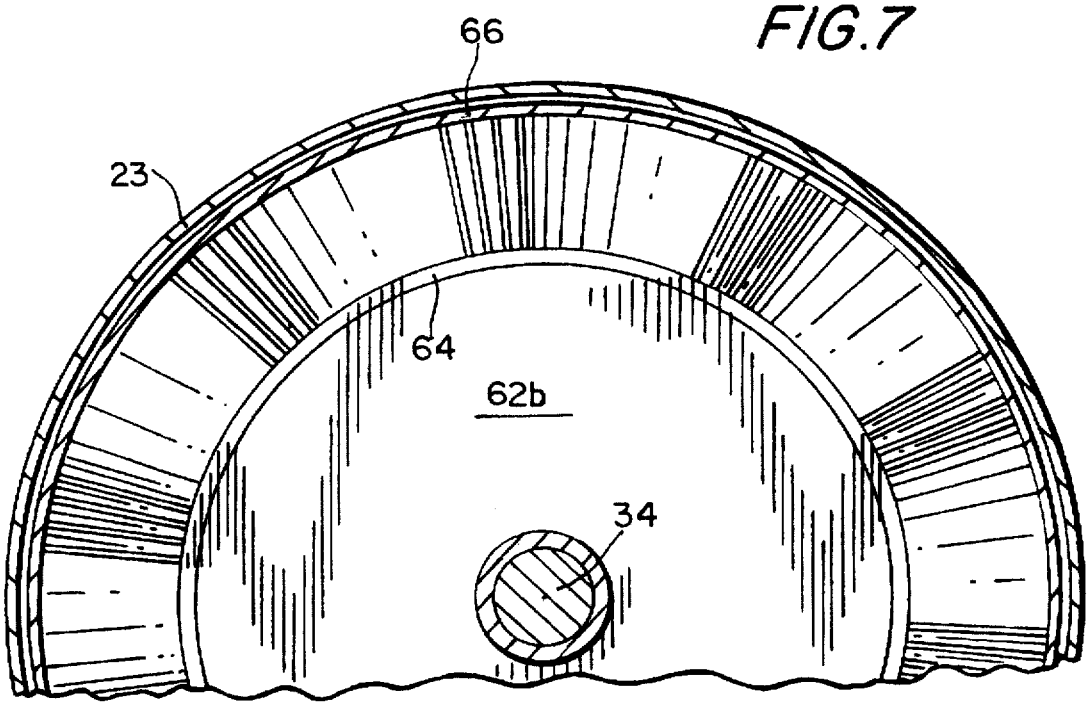
FIG. 7 is a rear elevation view of the reaction turbine wheel of FIG. 3.

Each section includes a power generation module 20 such that the motive fluid is passed from section to section thereby maximizing energy output while minimizing energy input. Referring to FIGS. 4 and 5, the sections include a cylindrical housing 21 containing a duct 22 with a duct wall 23. The duct has an upstream end 21*a* and a downstream end 21*b*. In operation, the air flows from the upstream side 21*a* (the left side of FIG. 4) downstream to the downstream side 21*b* (the right side of FIG. 5). The ends of the housing fit into the ends of elbows 24 (see FIG. 1). Flexible sleeves 25 are disposed about the connection of the section and the elbow to reduce any leakage of the high pressure air. Clamps hold the sleeves in place. The clamps may be removed to provide periodic maintenance to the modules 20. It will be appreciated that other means for connecting the sections to the elbows, or to each other, may be employed and still practice the invention.

Elbow turning vanes 125 are disposed in the elbows 24 to direct the flow of air from section to section, thereby reducing turbulence. Turbulence results in the waste of energy in the system. Consequently, reducing the turbulence improves the overall efficiency of the system. Three elbow turning vanes per elbow are preferred but a different number may be employed depending on the particular application or size of the elbow. Currently, the elbow turning vanes are curved plates but other arrangements could also be used.

Figure 2:
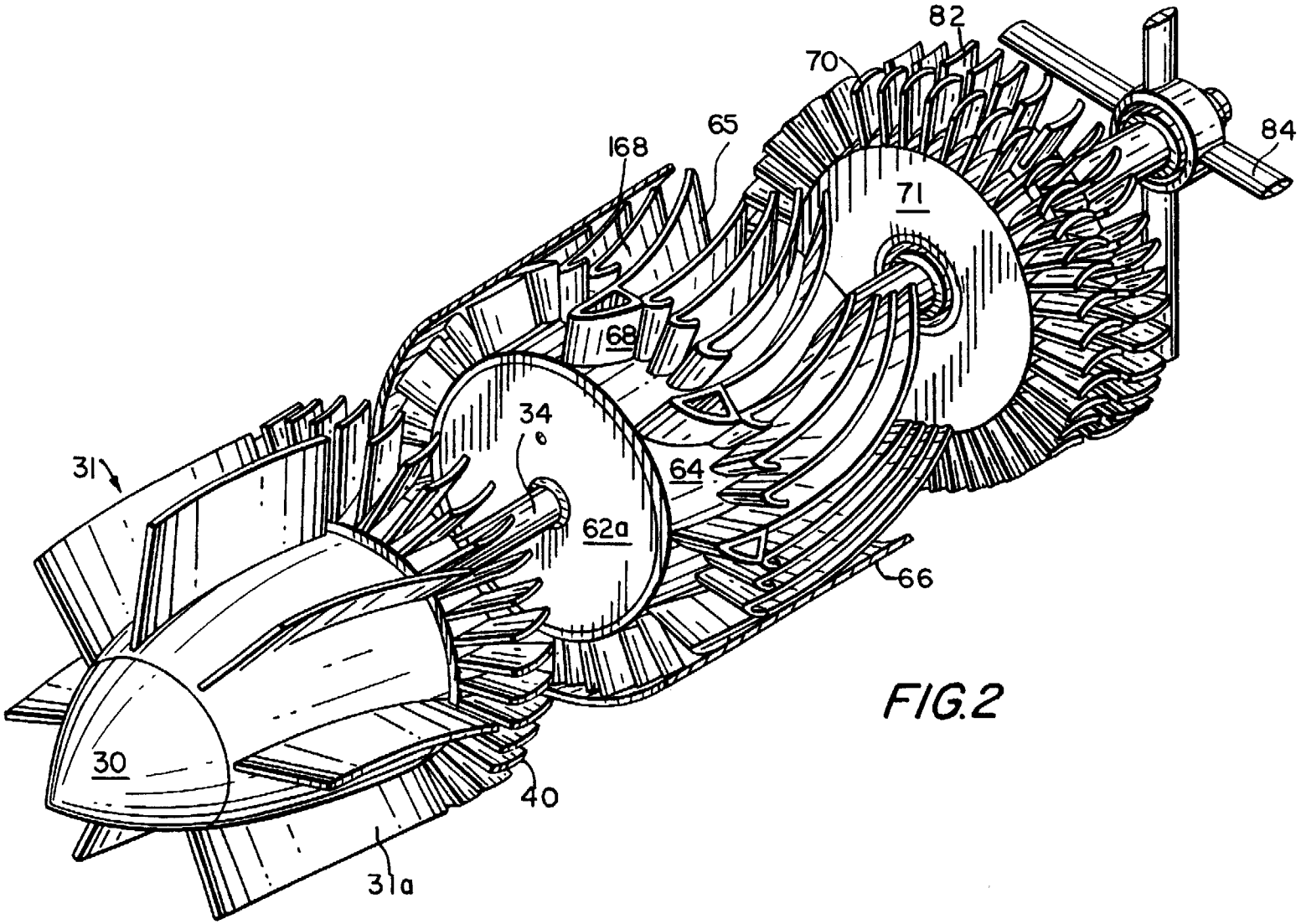
FIG. 2 is a schematic isolation view of a module for use with the system of FIG. 1.

FIG. 2 is a perspective view of the module 20 in isolation. The outer shroud 66 has been partially removed for clarity. A bullet-shaped nose cone 30 is attached to the wall 23 of the duct 22 by the support blades 31*a* of the front stator 31. Preferably, eight support blades are employed but this may be varied depending on the particular application. The support blades have an air foil-shape to reduce the drag on the passing air and are curved to direct the air in a clockwise direction. Preferably, the support blades are relatively long in the axial directin, thereby allowing for a gradual and smooth redirection of the air which reduces potential turbulence and increases efficiency.

Referring to FIGS. 2, 4 and 5, central shaft 34 is disposed in the nose cone 30 and is rotatably mounted on bearings 35 along the axis 25 of the duct. The front hub 41 of a front fan 40 is mounted to the central shaft by bearings such that the front fan can rotate independently of the central shaft. The front fan is driven by a diesel engine 42 which is preferably disposed outside the duct 23. The diesel engine is operably engaged to the front hub 41 by a transmission 142 which is be positioned in the support blades 31*a* of the front stator 31. An electric motor 43 may be disposed in the nose cone 30 and be operably engaged to the front hub. The power wires 143 for the electric motor also pass through the support blades. The transmission and the electric motor are directly attached to the front hub by a front shaft 144 and a gear drive 145 (shown schematically). It will be appreciated that the location of the transmission and the mechanism for attaching the transmission to drive the front hub may be altered and still practice the invention. Should the diesel engine need repair or maintenance, the electric motor can be brought on-line to A drive the front fan. Of course, other types of motors or engines may be employed to drive the front fan, as one skilled in the art would appreciate.

The front fan 40 is an axial flow fan whose geometry should be selected based upon the operating parameters of the system, as one skilled in the art would appreciate. In particular, the front fan is designed to take advantage of the direction imparted to the motive fluid by the support blades 31*a*. As the front fan rotates, the pressurized air is blown from the upstream side 21*a* of the duct to the downstream side 21*b*. This causes the air to be pulled from the preceding section and pushed to the subsequent section. It is preferred that the front hub 41 of the front fan has a diameter to match the diameter of the nose cone 30 such that air flow is restricted to the area near the wall 23 of the duct.

The angle of the downstream edge of the support blades 31*a* is preferably about 25°–30° in a clockwise circumferential direction from parallel to the axis 25. Of course, this angle can be altered depending upon the operating parameters of the system. The front fan 40 preferably rotates in a clockwise direction, further increasing the circumferential component of the flow of the air. Currently, the front fan blades are simple, curved plates as shown in FIG. 2. However, other designs may be employed as a particular application requires.

A pressure chamber/reaction turbine wheel 60 is located downstream of the front fan 40 and includes a front disc 62*a* and a rear disc 62*b* which are securely mounted on the central shaft 34 for rotational movement about the axis 25 of the duct 22. Apertures may be positioned in the discs to equalized the air pressure from the upstream side to the downstream side, preventing bowing of the discs. Preferably, the space between the discs is hollow, thereby lessening the weight of the reaction turbine wheel.

Figure 3:
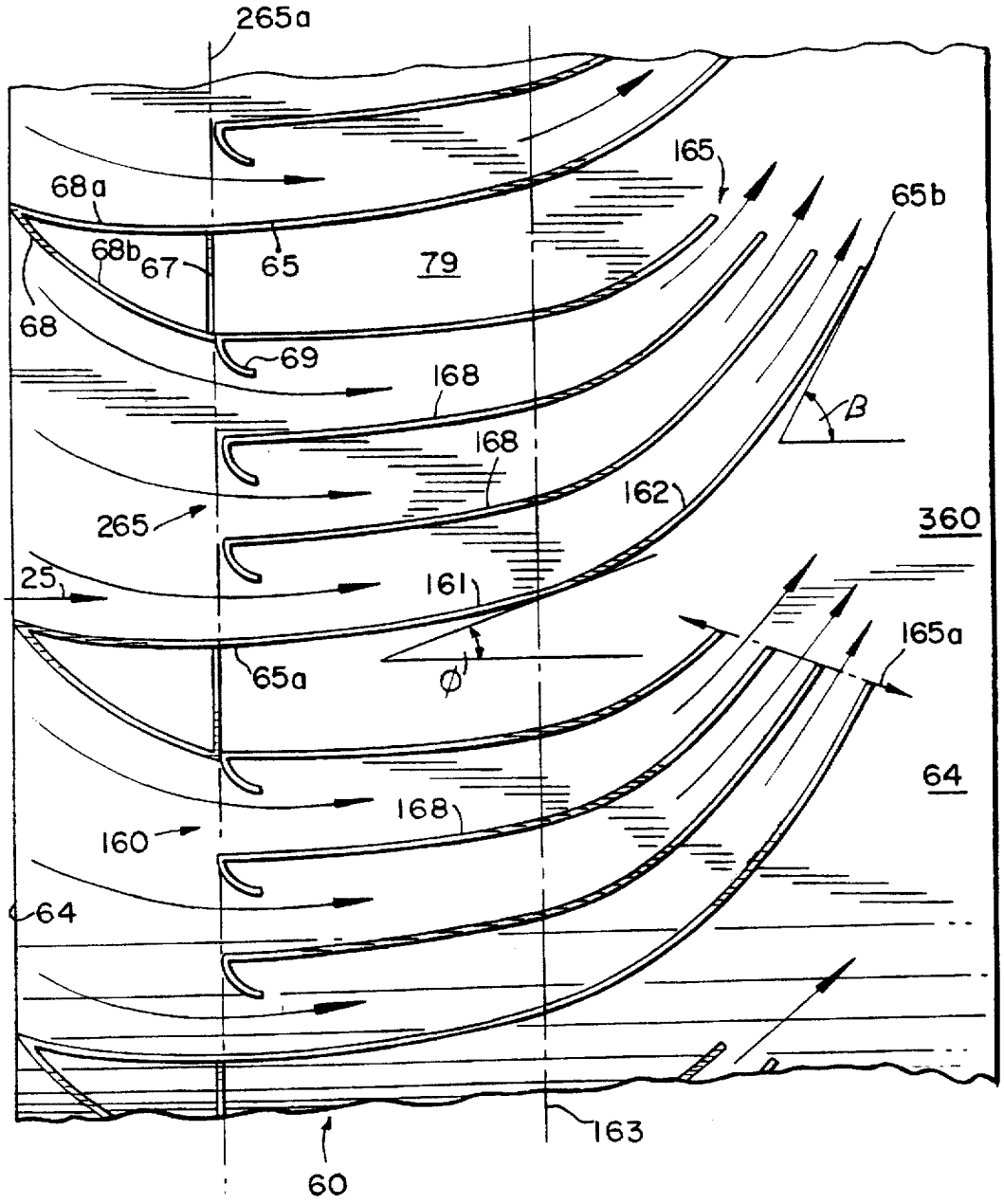
FIG. 3 is a cutaway view of a pressure chamber reaction turbine wheel for use with the system of FIG. 1.

An inner shroud 64 having a cylindrical shape is mounted coaxially to the discs 62*a* and 62*b*. The outer shroud 66 is a cylindrical sleeve mounted coaxially with the inner shroud. Referring to FIG. 3, plates 65 having roughly a J-shape are mounted to the exterior of the inner shroud and to the interior of the outer shroud 66. The plates have an inlet edge 65*a* and an outlet edge 65*b*. Pressure vanes 168 are disposed between the plates and are also mounted to the exterior of the inner shroud and the interior of the outer shroud. The pressure vanes have a J-shape matching the shape of the plates. Preferably, there are two pressure vanes between alternate adjacent plates. Preferably, there is a total of about 72 plates and pressure vanes. The inner shroud and the outer shroud extend beyond the downstream edge of the plates and define a downstream flow zone 360. Preferably, there are 72 plates between the shrouds. An intermediate shroud may be employed as a stiffening plate. The intermediate shroud is a cylindrical sleeve attached to the plates 65 and pressure vanes 168 at a midpoint between the inner shroud and the outer shroud. The intermediate shroud connects adjacent plates and pressure vanes, providing structural support and helping to direct the motive fluid, thereby decreasing turbulence and increasing efficiency.

The inner shroud 64 and the outer shroud 66 form an annular tube through which the pressurized air passes between the plates 65. A face plate 67 attaches alternate, adjacent plates 65 (see FIG. 3) such that the air passes through the annular tube only between every other pair of plates. The plates, inner shroud and outer shroud thus define pressure chambers 160 through which the air passes. The pressure vanes 168 are disposed in these pressure chambers. The plates, the inner shroud and the outer shroud also define pressure channels 79 between the pressure chambers. The pressurized air does not flow through the pressure channels since the face plates close off their ends. As discussed below, this creates a pressure differential which improves the efficiency of the pressure chamber reaction turbine wheel.

A pressure vane extension 68 may be attached to the face plate to direct the air more smoothly into the pressure chambers. The pressure vane extensions are preferably wedge shaped, and curved to form a gentle hook. At the upstream edge, the front face 68*a* of the hook is at about 10–20 degrees with respect to the axis and the rear face 68*b* of the hook is at 40–50 degrees with respect to the axis. Due to the shape of the pressure vane extensions, the turbulance of the pressurized air entering the pressure chambers 160 is reduced and efficiency (and thus energy output) is increased.

The plates 65 and pressure vanes 168 include an upstream portion 161 and a downstream portion 162, both of about equal length in the axial direction, separated by an intermediate plane 163. Preferably, the downstream portion extends in the axial direction about 40–120% of the distance of the upstream portion in the axial direction. At the upstream edge, the surface of the plate 65 is about parallel with the axis 25. At the downstream edge of the plate, the plate surface is at about 70° with respect to the axis. The upstream portion extends in a substantially axial direction but does include a gentle bend in a first circumferential direction along the surface of the inner shroud 64. In particular, at the outlet of the upstream portion, the plates are angled at an angle $\phi$ of about 14° with respect to the axis. The downstream portion continues to bend smoothly such that the plates are at an angle $\beta$ of about 70° with respect to the axis at the outlet of the downstream portion.

The plates 65 and pressure vanes 168 are positioned such that they are closer at the outlet 165 (that a is, the downstream end) than at the inlet 265. Preferably, the surface area at the inlet to the pressure chambers 160 is about 180%–220% of the surface area at the outlet of the pressure chamber. Most preferably, the surface area at the inlet to the pressure chambers is about 200% of the surface area at the outlet of the pressure chamber. The pressure plates are sized such that the outlet plane 165*a* of the pressure chamber 160 is at 20° with respect to the axis 25.

To maximize the efficiency and energy output of the system, it is intended that the pressurized air pass through the pressure chambers 160 in a choked condition. This condition will act as a limit on the amount of air flowing through the pressure chambers. This is of particular concern since the front fan 40 will be creating a high pressure condition at the inlet 265 of the pressure chambers while the aft fan 82 creates a low pressure condition at the outlet 165 of the pressure chamges. The choked condition reduces turbulance through the pressure chamber/reaction turbine wheel 60, while maintaining maximum pressure in the pressure chambers thereby increasing the efficiency of the system.

The plates 65 are sized so that they do not reach the downstream end of the inner shroud 64 or the outer shroud 66. Consequently, the air passes through the downstream flow zone 360 of the annular tube after exiting the pressure chambers 160. The pressurized air exiting the pressure chambers 160 is prevented from expanding because its flow path is bordered by the inner shroud and outer shroud, as well as the air exiting adjacent pressure chambers. This creates a jet effect, resulting in greater rotation of the pressure chamber/reaction turbine wheel as well as increased efficiency for the system.

The upstream edges of the pressure vanes 168 are disposed in the same inlet plane 265A as the upstream ends of the plates 65. The downstream edges of the pressure vanes are disposed in the same outlet plane 165A as the downstream ends of the plates. Flanges 69 may be attached to the upstream ends of the plates and the pressure vanes at an angle of about 40° with respect to the axis. The flanges cooperate with the pressure vane extensions 68 to direct the air into the pressure chambers. The air is directed smoothly onto the front face of the pressure vanes or the plates, thereby reducing any turbulance fored by entering the pressure chambers. This redirection of the air also causes the air to "squeeze" into the pressure chamber, increasing the pressure differential.

A rear stator, such as exit turning vane 70, is mounted to the duct wall 23 and extends radially inward to an rear barrel 71. The central shaft 34 is supported by bearings 35 mounted to support beam 170 extending inward from the barrel. At the upstream edge, the exit turning vanes are angled to match the downstream angle of the pressure chambers 160, that is, about 70° with respect to the axis 25. The turning vanes are curved such that the downstream end of the exit turning vanes are about parallel to the axis. It is preferred that the exit turning vanes are relatively long in the axial direction. Consequently, the pressurized air is redirected gradually and smoothly along the length of the vane, thus reducing turbulance and increasing efficiency.

An aft fan 82 is mounted to a gear box 74 which, in turn, is mounted to the central shaft 34 at a position downstream of the exit turning vanes 70. Thus, the central shaft drives the aft fan at a fixed speed with respect to reaction turbine wheel 60. Preferably, the aft fan rotates faster than the reaction turbine wheel. In particular, it is currently preferred that the aft fan rotates at a speed of 110% of the speed of the central shaft. As the aft fan 82 rotates, the air is pulled through the modules, including the pressure chambers 160.

If desired, support beams 84 may be provided downstream of the aft fan 82. The central shaft 34 may be mounted to the support beams by bearings 35.

A generator input shaft 90 may be attached to the central shaft 34 and extend through the duct 22 to an electric generator 400. The generator may be any commercially available generator which converts the energy of a rotating shaft into electric power. The input shaft of the generator is attached to the central shaft by any convenient transmission, as a particular application dictates. For example, the central shaft could be extended directly out of the elbow and straight into the generator as shown in the drawings. Alternatively, any direct drive transmission may be attached to the central shaft and drive the input shaft of the generator.

Magnets may be mounted to the periphery of the outer shroud 66. A coil could then be mounted to the duct 22 near the outer shroud such that, as the magnets are rotated, a magnetic current is created in the wires. These and various other mechanisms can be employed to withdraw the power from the rotating reaction turbine wheel and still practice the invention.

To operate the system of the present invention, the air pump 2 is activated, generating compressed air. The compressed air is delivered to the manifold 4 and passed to the modules directly or through the accumulator 3. The air is delivered to the modules in a controlled fashion such that there is no drastic temperature change in the modules. The air pressure is preferably elevated such that, during operation, the air passes through the pressure chambers 160 in a choked condition. This pressure will vary based on the geometry and operating parameters of the system, as one skilled in the art would appreciate.

The diesel engines 42 are started as pressurized air is introduced into the modules 22. The diesel engines drive the front fan 40, causing it to rotate in a clockwise direction. The front fan draws the air into the modules and through the front stator blades 31. Preferably, the air leaving the front fan is flowing in a slightly clockwise direction at an angle of about 25–30 degrees with respect to the axis 25.

After the front fan 40, the pressurized air passes to the reaction turbine wheel 60. The air is directed between the pressure vanes extensions 68, and in between the inner shroud 64 and the outer shroud 66. The flanges 69 direct the air to the front surfaces of the plates and the vanes 168. As the air passes along the front surfaces, it exerts a force against the vanes and the plates which causes the reaction turbine wheel to turn in a clockwise direction. As the air exits the pressure chambers, it is believed to create a jet effect in the downstream flow zone 360, further causing the reaction turbine wheel to rotate. This jet effect is believed to be extended because the inner and outer shroud extend beyond the downstream edges of the plates and the vanes. It is also believed that a low pressure region will exist in the pressure channels 79 which may also increase the turning of the reaction turbine wheel.

After exiting the pressure chambers 160, the air passes to the aft turning vanes 70 where the air, which is preferably swirling at about 70 degrees with respect to the axis 25, is turned to flow in a direction substantially parallel to the axis. After leaving the turning vanes, the air passes to the aft fan 82. The aft fan, which is being driven by the central shaft 34 via the gear box 74, draws the air through the aft turning vanes. Preferably, the aft fan is rotating at about 110% of the speed at which the reaction turbine wheel is rotating. After the aft fan, the air passes to the elbow 24 and is directed to the next module.

Periodically, there may be air leaks which cause a reduction in the air pressure during operation. At those times, the valve 5 can be opened, allowing high pressure air to pass from the accumulator 3 to the modules 20. Once the system is operating, it is believed that there will be a reduction in the power necessary to drive the front fans 40. The power generated by the system may be employed, at least in part, to power the diesel engine 42 or the electric motor 43, thereby causing the front fan to rotate.

While this invention has been described with reference to specific embodiments disclosed herein, it is not confined to the details set forth and the patent is intended to include modifications and changes which may come within and extend from the following claims.

I claim:

1. An apparatus for generating power comprising:

a plurality of modules connected in a closed loop, at least one module comprising:

a duct having an axis, an upstream side and a downstream side, wherein a motive fluid passes through the duct from the upstream side to the downstream side;

an inlet fan mounted in the duct for rotation about an axis and disposed proximate to the upstream side;

a central shaft disposed along the axis of the duct for rotational movement;

a reaction turbine wheel mounted to the central shaft in the duct downstream of the inlet fan, the reaction turbine wheel having a plurality of pressure chambers defined by plates which are disposed about the periphery of an inner shroud, each pressure chamber having an inlet and an outlet, wherein the reaction turbine wheel is rotatable about the axis in a first circumferential direction, and wherein the plates are curved from an upstream portion to a downstream portion in a second circumferential direction, opposite the first direction;

an aft fan mounted to the duct downstream of the reaction turbine wheel and operably engaged to the central shaft via a gear box such that the aft fan rotates at a fixed speed with respect to the reaction turbine wheel; and a power generation means operably engaged to the reaction turbine wheel such that rotation of the reaction turbine wheel results in the generation of power.

2. The apparatus of claim 1 further comprising a rear stator mounted to the duct downstream of the reaction turbine wheel having blades disposed proximate to the outlet of the pressure chambers.

3. The apparatus of claim 1 further comprising a front stator mounted to the duct upstream of the inlet fan.

4. The apparatus of claim 1 further comprising means operably engaged to the inlet fan for driving the inlet fan.

5. The apparatus of claim 1 wherein the reaction turbine wheel has a circular profile, the inlet of each pressure chamber having a substantially rectangular shape and the outlet of each pressure chamber having a substantially rectangular shape, and wherein the inlet has a greater surface area than the outlet.

6. The apparatus of claim 1 further comprising pressure vane extensions mounted to an upstream side of the reaction turbine wheel between alternate adjacent plates, the pressure vane extensions providing a curved surface to the air for directing the air into the pressure chambers.

7. The apparatus of claim 1 wherein the reaction turbine wheel comprises:

at least one disc mounted to the central shaft;

the inner shroud having a cylindrical shape and mounted to the disc coaxially with the central shaft;

wherein the plates are a series of arced plates extending radially from the inner shroud;

an outer shroud having a cylindrical shape and mounted to the arced plates distal to the inner shroud and coaxially with the central shaft;

wherein the pressure chambers are defined by adjacent arced plates, the inner shroud and the outer shroud; and face panels connecting upstream edges of alternate consecutive pairs of arced plates and defining pressure channels between the alternate adjacent pressure chambers.

8. The apparatus of claim 7 wherein the inner shroud and the outer shroud are longer in the axial direction than the curved plates thereby defining a flow zone.

9. The apparatus of claim 7 wherein the plates comprise a first portion and a second portion having a similar length in the axial direction, the first portion extending in a substantially axial direction and the second portion bending in the second circumferential direction.

10. A turbine wheel having an inlet and an outlet for use with an electric power generator, the turbine wheel comprising:

a central shaft having an axis, an upstream end proximate to the inlet and a downstream end proximate to the outlet;

a front disc mounted to the central shaft at the upstream end;

a rear disc mounted to the central shaft at the downstream end;

an inner shroud having a cylindrical shape mounted to the front disc and the rear disc coaxially with the central shaft;

a series of arced plates extending radially from the inner shroud;

an outer shroud having a cylindrical shape mounted to the arced plates distal to the inner shroud, coaxially with the central shaft, wherein the inner shroud, the outer shroud and the plates define pressure chambers; and face panels connecting the front edges of alternate consecutive pairs of arced plates and defining pressure channels between adjacent pressure chambers.

11. The turbine wheel of claim 10 wherein the face panels comprise pressure vane extensions having a wedge shape with a point.

12. The turbine wheel of claim 11 wherein the inner shroud and the outer shroud are longer in the axial direction downstream than the arced plates, thereby defining a downstream flow zone.

13. The turbine wheel of claim 10 wherein the plates comprise a first portion and a second portion, wherein the first portion is upstream of the second portion, the first portion extends in a substantially axial direction and the second portion curves a significant amount in a circumferential direction.

14. The turbine wheel of claim 13 wherein a downstream end of the second portion extends at about 70° with respect to the axis.

15. The turbine wheel of claim 13 further comprising flanges mounted to the inlet edges of the plates and extending into the pressure chambers.

16. The apparatus of claim 15 wherein the inner shroud and the outer shroud extend upstream beyond the plates.

17. The turbine wheel of claim 16 wherein the pressure vane extensions are curved along the inner shroud parallel, at least in part, to the plates.

18. The turbine wheel of claim 17 wherein the inlet of the pressure chamber has a larger surface area than the outlet of the pressure chamber.

19. An apparatus for the generation of power using pressurized air comprising:

a duct having an inlet end and an outlet end such that the pressurized air passes from an upstream position at the inlet to a downstream position at the outlet;

a front stator mounted to the duct for directing the air, at least in part, in a clockwise direction;

an inlet fan mounted in the duct downstream of the front stator for rotational movement;

a means for rotating the inlet fan;

a central shaft disposed axially in the duct;

a reaction turbine wheel mounted to the central shaft for rotational movement in the duct, the reaction turbine wheel being disposed downstream of the inlet fan and including an inner shroud and pressure chambers disposed about the inner shroud, wherein the chambers are curved circumferentially in a counter clockwise direction along the surface of the inner shroud from the upstream side to the downstream side;

rear turning vanes mounted in the duct downstream of the reaction turbine wheel for directing the air to a more axial direction;

an aft fan mounted to central shaft via a gear box and disposed downstream of the rear turning vanes, wherein the aft fan rotates at a fixed speed with respect to the reaction turbine wheel; and a power generation means operably engaged to the reaction turbine wheel such that the rotation of the reaction turbine wheel results in the generation of power.

20. The apparatus of claim 19 wherein the aft fan rotates at about 110% of the speed of the reaction turbine wheel.

* * * * *